United States Patent [19]

Vanderminden

[11] 4,315,467

[45] Feb. 16, 1982

[54] COLLAPSIBLE COCKTAIL TABLE

[75] Inventor: Robert D. Vanderminden, Granville, N.Y.

[73] Assignee: The Telescope Folding Furniture Co., Inc., Granville, N.Y.

[21] Appl. No.: 73,389

[22] Filed: Sep. 7, 1979

[51] Int. Cl.[3] ..... A47B 3/06

[52] U.S. Cl. ..... 108/157; 248/188.6

[58] Field of Search ..... 108/153, 157; 248/163, 248/432, 167, 431, 188.6, 188.2

[56] References Cited

U.S. PATENT DOCUMENTS

| | | | |
|---|---|---|---|
| 1,940,565 | 12/1933 | Schott | 108/154 X |
| 1,951,499 | 3/1934 | Brown | 108/154 |
| 2,324,252 | 7/1943 | Woelfer | 108/157 |
| 3,032,380 | 5/1962 | Danciart et al. | 108/154 X |
| 3,160,121 | 12/1964 | Bedol | 108/157 |
| 3,267,889 | 8/1966 | Bedol | 248/431 X |
| 4,112,855 | 9/1978 | Colby | 248/188.6 |

*Primary Examiner*—James T. McCall

*Attorney, Agent, or Firm*—Kenyon & Kenyon

[57] ABSTRACT

The cocktail table leg assembly includes three legs which are pivotally secured together in order to support the table top in a non-rockable manner. Each leg of the leg assembly includes a resiliently deformable tip for frictionally engaging against the peripheral flange of the table when in assembled condition.

14 Claims, 8 Drawing Figures

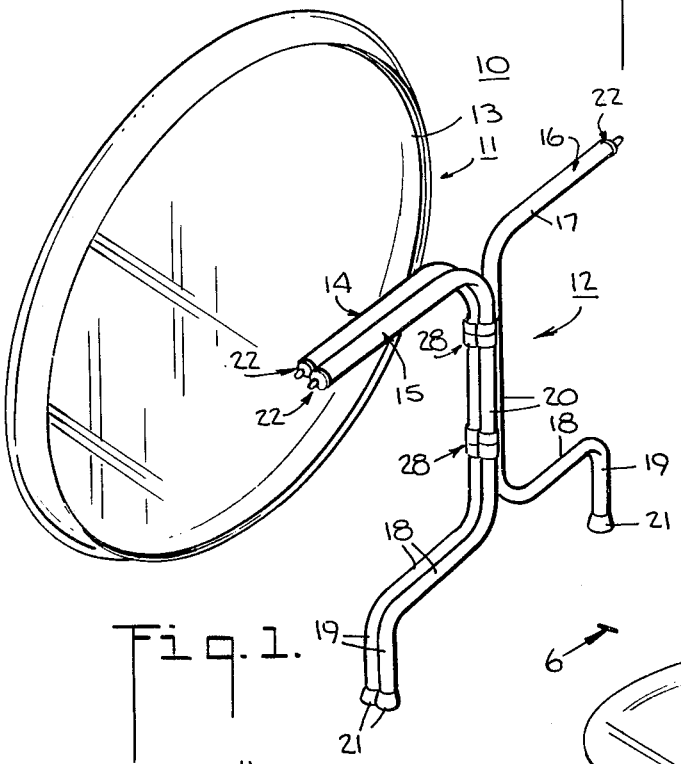
Fig. 1.
Fig. 5.
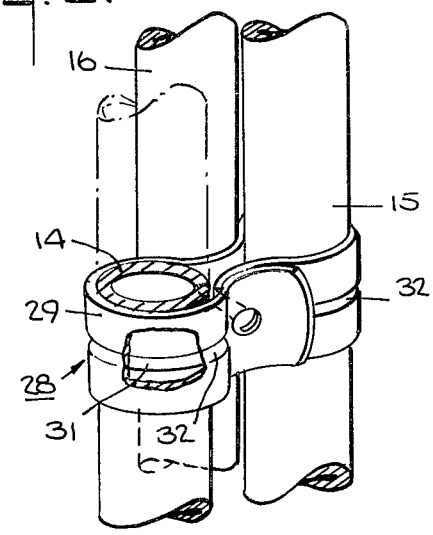
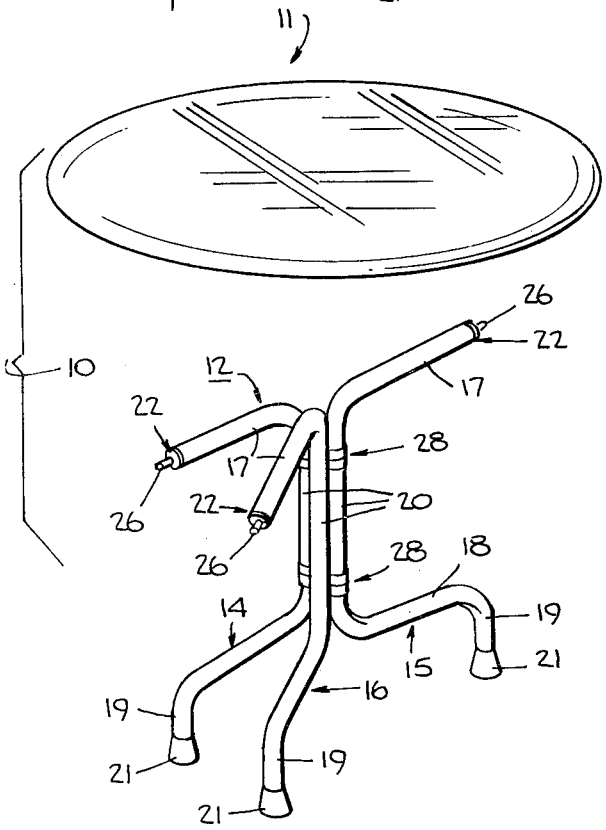
Fig. 2.
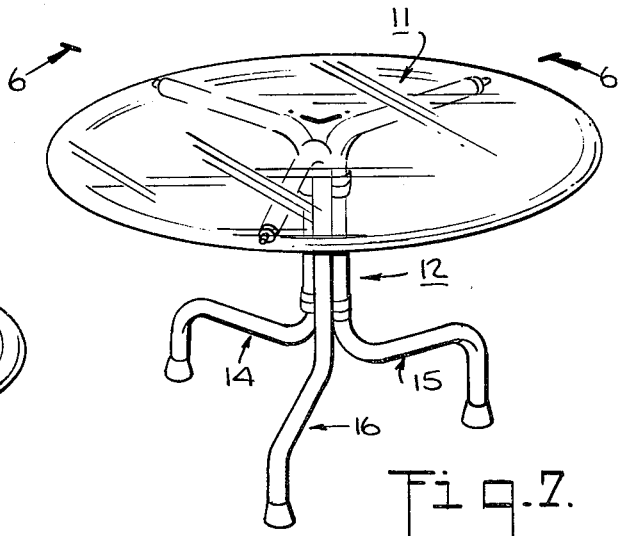
Fig. 7.
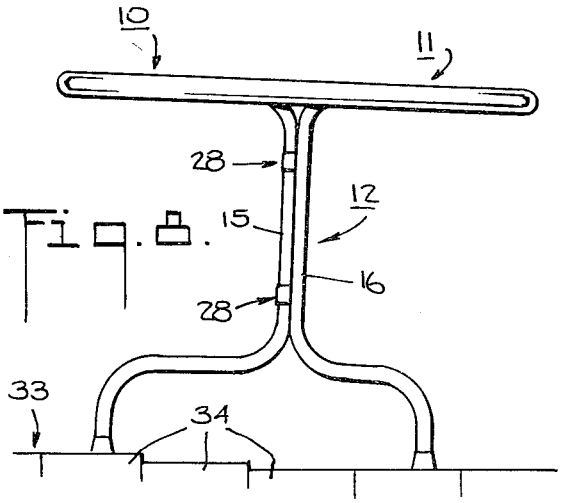
Fig. 8.

COLLAPSIBLE COCKTAIL TABLE

This invention relates to a cocktail table. More particularly, this invention relates to a collapsible cocktail table.

As is known, various size tables have been made for outdoor, for example on patios, at poolside and the like use. In some cases, the tables have been sized with relatively small dimensions to function as cocktail tables. Generally, these tables have been made of corrosion resistant materials to resist weathering.

In some cases, these cocktail tables are made of rigid construction with a tabletop fixed, for example, via bolts to a leg assembly. However, these tables cannot be readily stored when not in use. In other cases, in order to permit ease of storage, cocktail tables have been made of collapsible construction wherein a tabletop can be folded with a leg assembly into a flattened condition.

One particular type of collapsible cocktail table which is known is constructed of a tabletop and a pair of leg assemblies which can be manually fitted into the tabletop to form an integrated unit. In this case, the two leg assemblies are interfitted within each other in cross-relationship to form four legs which are spaced at 90° from each other. The four legs are then fitted into the tabletop by virtue of a depending curved annular flange on the tabletop. In this regard, three legs are fitted into the tabletop and then a slight deformation or bending of the tabletop is required to permit insertion of the last leg. While such a table can be easily shipped and assembled, the resultant four legged construction imparts a certain degree of instability to the table. That is, if placed upon an uneven support surface, for example an uneven brick patio, the table may rest on only two or three of the four support legs. Thus, should a weight be placed upon the table at a point above or near the leg not resting on the support surface, the table is subject to tipping about in the direction of this leg. Such tipping, apart from being bothersome, may well cause tipping over or spilling of e.g. a liquid filled glass placed on the table.

Accordingly, it is an object of this invention to reduce the risk of tipping of a cocktail table.

It is another object of the invention to provide a collapsible cocktail table which cannot be easily tipped.

It is another object of the invention to provide a cocktail table for outdoor use which has a three point support.

It is another object of the invention to provide a cocktail table which can be easily assembled.

Briefly, the invention provides a cocktail table which is comprised of a table top e.g. of flat shape having a depending peripheral edge and a leg assembly including three pivotally interconnected legs which support the table top. Each leg includes an outwardly directed portion which is frictionally engaged with the peripheral edge so as to secure the legs and tabletop together in an assembled unit.

Any suitable means may be used to interconnect the three legs of the leg assembly together such that at least one leg is pivotal with respect to the other legs. For example, the means may include at least one strap which is secured to one of the legs by a suitable means and which envelops the other two legs so that these latter two legs are free to pivot relative to the first leg.

Each leg of the leg assembly is formed with an outwardly directed portion with a support foot at one end and a vertical post portion which connects the two outwardly directed portions of the leg together. In addition, the upper outwardly directed portion of each leg includes a resilient tip, which deformably engages against the peripheral edge of the table top.

The cocktail table can be made of any suitable materials, for example, the legs can be made of tubular metal construction such as of aluminum while the resilient tip is made of a resiliently deformable plastic. The table top may also be made of metal, acrylic, or any other suitable material.

The top and leg assembly of the cocktail table can be shipped and/or stored in a knock-down fashion and can be readily assembled when required. In order to assemble the table, the table top is placed on a flat surface in an upside down condition. Next the leg assembly is placed on the inverted table top with the outwardly directed portions within the plane of the peripheral edge of the table top. Next, two of the legs, namely the "fixed" leg and one "pivotal" leg are disposed approximately 120° from each other. At this time, the third "pivotal" leg is disposed adjacent to the "fixed leg." Thereafter, this third leg is swung in an arc so as to be disposed equi-distant from the remaining two legs. At this time, the resilient top of this third leg comes into frictional contact with the peripheral edge of the table top and is deformed upon being brought into final position. At the same time, the resilient tips on the ends of the other two legs deformably engage with the edge of the table top. Thereafter, the assembled unit is flipped over and is ready for use.

Because the table is supported at only three points, tipping on an uneven surface is precluded. That is, should the table be placed on an uneven surface, the three legs will provide a tripod support so that the table will not be tippable or rockable although the table top itself will be diposed in angular relation to a horizontal plane.

These and other objects and advantages of the invention will become more apparent from the following detailed description and appended claims taken in conjunction with the accompanying drawings in which:

FIG. 1 illustrates a leg assembly and a table top for a cocktail table according to the invention;

FIG. 2 illustrates an exploded view of a cocktail table according to the invention;

FIG. 5 illustrates a fragmentary view of a securing means for securing the legs of the leg assembly together in accordance with the invention;

FIG. 7 illustrates a perspective view of a table according to the invention utilizing a transparent acrylic top; and FIG. 8 illustrates a side view of a cocktail table according to the invention on an uneven support surface.

Referring to FIG. 1, the cocktail table 10 is comprised of a table top 11 and a leg assembly 12.

Figure 3:
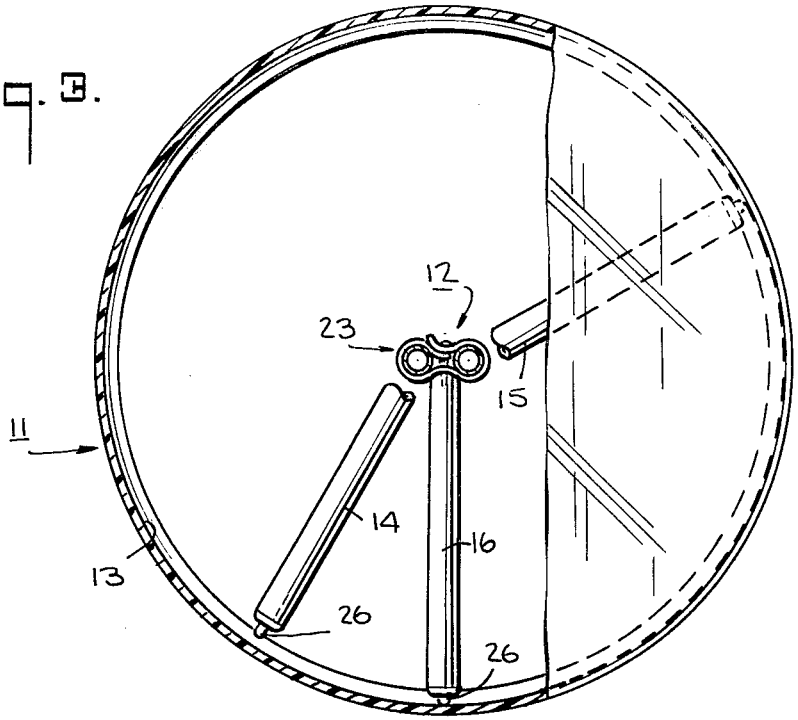
FIG. 3 illustrates a plan view of a table top during an initial phase of assembly in accordance with the invention.
Figure 6:
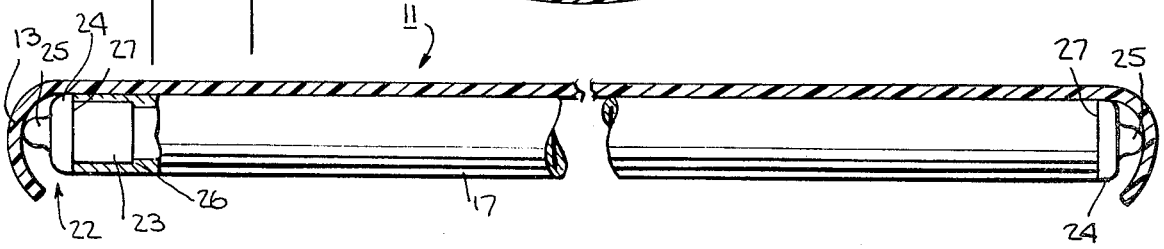
FIG. 6 illustrates a partial cross-sectional view of the cocktail table taken on line 6—6 of FIG. 7.

As shown in FIGS. 1, 3 and 6, the table top 11 is of one piece construction and is of flat annular shape including a depending peripheral edge 13. This peripheral edge 13 is curved on a radius of curvature directed within the plane of the tabletop 11. The top may be made of any suitable material such as of aluminum, acrylic or other plastic material.

Referring to FIGS. 1 and 5, the leg assembly 12 is formed of three legs 14, 15, 16. Each leg 14, 15, 16 includes a radially outwardly directed portion 17 at the upper end, a second outwardly directed portion 18 including a support foot 19 at an end thereof, and a vertical post portion 20 which connects the two outwardly directed portions 16, 18 together in a generally U-shaped manner. Each leg 14, 15, 16 is made of tubular metal construction and the terminal end of each foot portion 19 is provided with a cap 21, for example of plastic material to protect against sharp edges.

Each outwardly directed portion 17 of a leg 14, 15, 16 is slidable along an underside of the table top 11 within the plane of the peripheral edge 13 (see FIG. 6). Each portion 17 also has a resilient top 22 for deformably engaging against the peripheral edge 13 of the table top 11 (see FIG. 6). Each resilient top 22 is made, for example of a resiliently deformable plastic and is fitted into the end of the outwardly directed portion 17 in a suitable manner. For example, each tip 22 has a hollow stem portion 23 which is fitted into the open end of a leg portion 17 in friction fit relation and a cap portion 24 which closes off the end of the leg portion 17 and has a projection 25 extending therefrom. The stem portion 23 includes a shouldered section 26 to facilitate insertion into the leg portion 17 and a shoulder 27 is formed between the stem and cap portions 23, 24 to abut the end of the leg portion 17. The shoulder 27 has a radial dimension equal to the thickness of the leg portion 17 so that the tip 22 presents a smooth appearance with the leg portion 17. The projection 25 is of a length, for example, of $\frac{1}{2}$ inch, and is longitudinally compressible.

The leg assembly 12 also includes means 28 for interconnecting the legs together in pivotal relation about a vertical axis as shown. As shown, in FIG. 5, each means 28 for interconnecting the legs 14, 15, 16 includes a strap 29, for example of aluminum, which envelops two of the legs 14, 15 and a means, such as a screw or bolt 30 which secures the strap 29 to the other leg 16. As indicated, the screw 30 passes through suitable holes in the overlapped ends and is threaded into the leg 16. The strap 29 is secured to the one leg 16 and envelopes the remaining two legs 14, 15 such that the two legs 14, 15 are pivotal relative to the "fixed" leg 16.

Referring to FIG. 5, each of the strap-enveloped legs 14, 15 is provided with a pair of spaced apart annular peripheral grooves 31 (only one of which is shown for simplicity) in the post portion 20, e.g. one groove near each end, while each strap 29 has a pair of ribs 32, each of which is received in a respective groove 31 for positioning the strap 29 about the legs 14, 15. As shown, each rib 32 projects inwardly into a groove 31 and extends over a length of the strap equal to about one-half the circumference of a leg 14, 15. The mating relation being the ribs 32 and grooves 31 inhibits the straps 29 from sliding along the legs 14, 15, particularly, after tightening of the screw 30 in place. The grooves 31 also provide a slight clearance for passage of the screw 30 between the legs 14, 15.

Figure 4:
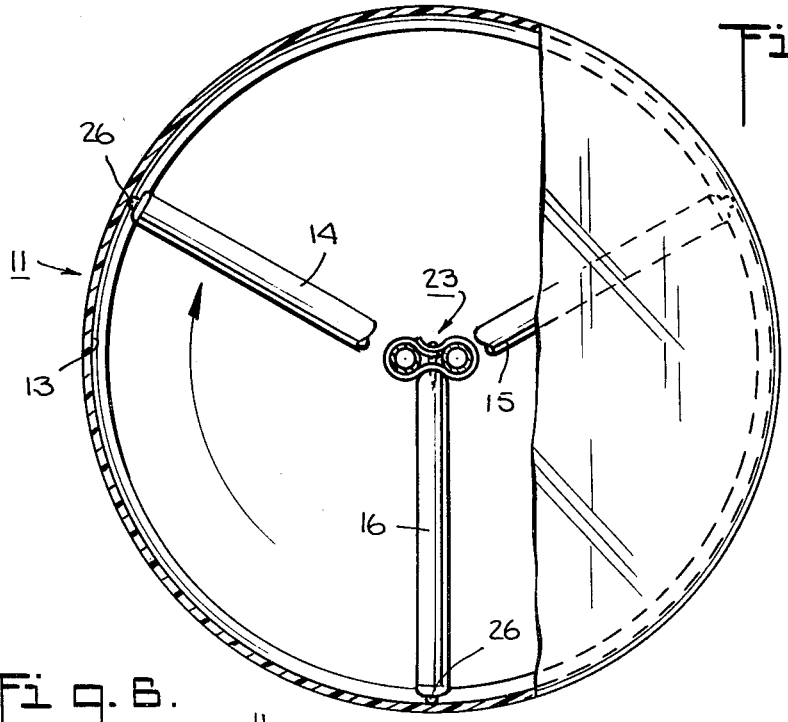
FIG. 4 illustrates a plan view of the table during a final stage of assembly in accordance with the invention.

In order to assemble the table 10, the table top 11 is first placed on a flat surface with the peripheral edge 13 upstanding. Next, the leg assembly 12 is placed on the inverted table top 11 with the resilient tips 22 of the fixed leg 16 and one of the "pivotal" legs 15 disposed under the peripheral edge 13. At this time, these two legs should be about 120° from each other. The remaining third "pivotal" leg 14 is disposed adjacent to the "fixed" leg 16 as indicated in FIG. 3. Thereafter, this pivotal leg 14 is pivoted within the straps 29 to a point approximately 120° from the fixed leg 16 as shown in FIG. 4. During this pivoting, the resilient projection 26 on the leg 14 comes into frictional engagement with the peripheral edge 13 of the table top 11 and is resiliently deformed until coming into final position (FIG. 4). At this time, the leg assembly 12 is firmly secured to the table top 11. The assembled table can then be inverted and put into use (see FIG. 7).

Referring to FIG. 8, should the cocktail table 10 be placed upon an uneven surface 33, such as a brick patio having an uneven level of bricks 34, the three support legs 14, 15, 16 of the leg assembly 12 permit a three point or tripod support of the table top 11. In this regard, the three feet portions 19 are each firmly supported on the support surface 33 although on different horizontal planes. At the same time, the table top 11 is disposed in a plane at an angle to the horizontal. However, the table 10 is not rockable about any two of the legs since all three legs are firmly supported on the surface 33.

In order to disassemble the table 10, a reverse sequence of steps is carried out from those noted above. That is, one of the pivotal legs 14, 15 is rotated towards the fixed leg 16 until the legs are loosened from the table top 11. At this time, the leg assembly 12 can be removed from the table top 11 and both components can be independently sorted in a flattened condition.

As shown in FIG. 1, the legs 14, 15, 16 of the leg assembly 12 can be disposed in a flattened condition for storage or transportation purposes. In this regard, the two pivotal legs 14, 15 are disposed in side-by-side parallel relation while the "fixed" leg 16 is directed in an opposite direction.

The invention thus provides a table which can be firmly supported on three points without being subject to a rocking condition.

The invention further provides a cocktail table which can be readily assembled in a fast and easy manner.

The invention further provides a leg assembly for a cocktail table which can be readily adapted to different sizes of table tops having peripheral flanges of different internal diameters. To this end, the resilient projections 26 on the legs are able to deform within a predetermined range to accommodate different sizes or internal diameters of flanges of table tops with which a leg assembly 12 could be utilized.

What is claimed is:

1. A collapsible table comprising a table top having a depending peripheral edge; and a leg assembly including three pivotally interconnected legs for supporting said table top, each said leg having a vertical post portion disposed about a vertical axis and a radially outwardly directed portion extending from said post portion for frictionally engaging said peripheral edge to secure said table top to said leg assembly with at least one of said legs being pivotal about said axis of a respective leg to frictionally engage said peripheral edge.

2. A collapsible table as set forth in claim 1 which further comprises means interconnecting said legs together.

3. A collapsible table as set forth in claim 1 wherein each leg has a second outwardly directed portion including a support foot at an end thereof with said vertical post portion connecting said outwardly directed portions together.

4. A collapsible table as set forth in claim 3 which further comprises means interconnecting said legs together for pivoting about a vertical axis, said means including at least one strap secured in fixed adjacent relation to one of said legs and enveloping the others of said legs in pivotal relation thereto.

5. A collapsible table as set forth in claim 4 wherein said other legs each have an annular peripheral groove in said post portion and said strap has at least one rib received in a respective groove for positioning said strap about said other legs.

6. A collapsible table as set forth in claim 1 wherein each portion includes a resilient tip projecting from said portion deformably engaging said peripheral edge.

7. A collapsible table as set forth in claim 1 wherein said table top is made of one-piece acrylic.

8. A collapsible table as set forth in claim 1 wherein said table top is made of one-piece metal.

9. A collapsible cocktail table comprising a one-piece circular table top having a depending peripheral edge;

three legs supporting said table top, each said leg having a support foot at one end, a vertical post portion having a vertical axis and a radially outwardly directed portion extending from said post portion for pivoting about said vertical axis and having a resilient top deformably engaging said peripheral edge;

at least one strap enveloping a vertical post portion of two of said legs in pivotal relation; and means securing said strap in fixed relation to the vertical post portion of the third leg of said legs whereby said two legs are pivotal relative to said third leg.

10. A collapsible cocktail table as set forth in claim 9 wherein said legs are made of metal and each said tip is made of plastic

11. A collapsible cocktail table as set forth in claim 9 wherein said peripheral edge is curved on a radius of curvature within the plane of said table top.

12. A collapsible cocktail table as set forth in claim 9 wherein each tip has a stem portion fitted into a respective leg and a cap portion having a projection extending therefrom into engagement with said peripheral edge.

13. A collapsible cocktail table as set forth in claim 9 wherein each of said two legs has an annular peripheral groove in said post portion and said strap has a rib received in each said groove for positioning said strap about said two legs.

14. A collapsible cocktail table as set forth in claim 9 wherein each outwardly directed portion of a leg is slidable along an underside of said table within the plane of said peripheral edge.

* * * * *

UNITED STATES PATENT AND TRADEMARK OFFICE

CERTIFICATE OF CORRECTION

PATENT NO. : 4,315,467

DATED : February 16, 1982

INVENTOR(S) : ROBERT D. VANDERMINDEN

It is certified that error appears in the above—identified patent and that said Letters Patent is hereby corrected as shown below:

Column 2, line 25, change "top" to --tip--

Column 3, line 20, change "top" to --tip--

Column 5, line 17, after "portion" insert --and--

Column 6, line 1, change "top" to --tip--

Signed and Sealed this

*Twenty-fifth* Day of *May 1982*

[SEAL]

*Attest:*

*Attesting Officer*

GERALD J. MOSSINGHOFF

*Commissioner of Patents and Trademarks*